US008261709B2

(12) United States Patent
Colliou et al.

(10) Patent No.: US 8,261,709 B2
(45) Date of Patent: Sep. 11, 2012

(54) INTERNAL-COMBUSTION ENGINE OF THE TYPE WITH AT LEAST ONE CYLINDER WORKING IN DEGRADED MODE

(75) Inventors: Thierry Colliou, Les Cotes d'Arey (FR); Stéphane Venturi, Roiffieux (FR); Yoann Viollet, Pringy (FR)

(73) Assignee: IFP, Cedex (FR)

( * ) Notice: Subject to any disclaimer, the term of this patent is extended or adjusted under 35 U.S.C. 154(b) by 189 days.

(21) Appl. No.: 12/562,299

(22) Filed: Sep. 18, 2009

(65) Prior Publication Data

US 2010/0064994 A1 Mar. 18, 2010

(30) Foreign Application Priority Data

Sep. 18, 2008 (FR) ..... 08 05134

(51) Int. Cl.
*F01L 1/18* (2006.01)

(52) U.S. Cl. ..... 123/90.39; 123/90.44; 74/559; 74/569

(58) Field of Classification Search ..... 123/90.39, 123/90.44; 74/559, 567, 569
See application file for complete search history.

(56) References Cited

U.S. PATENT DOCUMENTS 3,470,856 A * 10/1969 Gaines ..... 123/430
4,759,322 A * 7/1988 Konno ..... 123/90.16

* cited by examiner

*Primary Examiner* — Ching Chang
(74) *Attorney, Agent, or Firm* — Antonelli, Terry, Stout & Kraus, LLP.

(57) ABSTRACT

The present invention relates to an internal-combustion engine comprising at least one cylinder (10, 12, 14, 16) including intake means with an intake valve (22), exhaust means with an exhaust valve (32) and control means (40, 42) for controlling opening/closing of the valves, said control means comprising drive means (44) and means (56) intended for motion and load transmission between said control means and the valve to be controlled.

According to the invention, motion and load transmission means (56) comprise a rocker arm (58) with at least two rockers (72, 74) disengageable from a pad (62) controlling the motion of said valve.

14 Claims, 3 Drawing Sheets

INTERNAL-COMBUSTION ENGINE OF THE TYPE WITH AT LEAST ONE CYLINDER WORKING IN DEGRADED MODE

FIELD OF THE INVENTION

The present invention relates to an internal-combustion engine of the type with at least one cylinder working in degraded mode and to the use of such an engine for low-load or medium-load operation.

It relates more particularly, but not exclusively, to direct or indirect injection engines of gasoline type, but it does not rule out, in any way, diesel type direct injection engines.

BACKGROUND OF THE INVENTION

An engine usually runs with all of its cylinders. However, when this engine operates at low or medium loads, the engine efficiency is degraded by the friction and throttling contribution increase in the case of gasoline type engines.

It has already been proposed to operate only part of the cylinders of this engine and to make the remaining part inactive, which allows to increase the load on the cylinders remaining active.

Fuel injection is therefore cut off only in the cylinders to be deactivated. This allows to favour fuel consumption reduction by injecting the necessary fuel only into the cylinders required for energy production for an engine operation at low or partial loads.

Thus, by way of example in the case of a four-cylinder engine, two cylinders can be made inactive, which allows to obtain combustion in the active cylinders for each crankshaft revolution.

Although this type of engine operation is satisfactory, it however involves some drawbacks that are in no way insignificant.

In fact, since the exhaust and intake valve lift laws remain unchanged, the various intake and exhaust phases of the inactive cylinder(s) will lead to dysfunctions.

Thus, when the supply of fuel to the cylinder to be made inactive is stopped, no fuel mixture is achieved in the combustion chamber and only a volume of air is present after the intake phase. This volume is then going to be compressed during the phase of this cylinder that corresponds to its compression phase. During the phase that follows this compression phase, and in the absence of combustion, the piston is not subjected to a force resulting from the expansion of the burnt gases and it only expands a volume of compressed air. This generates cooling of the air contained in the cylinder and this temperature decrease is transmitted to the cylinder wall. This cooling is also transmitted to the entire exhaust line during the exhaust phase of the inactive cylinder with a motion of the piston from the bottom of the cylinder to the top of the cylinder. During this motion, the cold expanded air is driven by the piston towards the exhaust valve and it travels the entire exhaust line while causing cooling thereof as well as dilution of the exhaust gases. This can pose considerable problems as regards the various depollution means this line is equipped with, notably catalysts.

Furthermore, when the initially deactivated cylinders are restarted, they are cold and they therefore make it difficult to achieve combustion of the fuel mixture.

The present invention aims to overcome the aforementioned drawbacks by means of an engine of simple and economical design allowing to further reduce the fuel consumption while maintaining the temperature of the cylinders.

SUMMARY OF THE INVENTION

The present invention therefore relates to an internal-combustion engine comprising at least one cylinder including intake means with an intake valve, exhaust means with an exhaust valve and control means for controlling opening/closing of the valves, said control means comprising drive means and means intended for motion and load transmission between said control means and the valve to be controlled, characterized in that the motion and load transmission means comprise a rocker arm with at least two rockers disengageable from a pad controlling the motion of said valve.

The control means can comprise a camshaft carrying cams cooperating with each rocker.

One of the cams can comprise a cam profile cooperating with one of the rockers that is different from the cam profile of the other cam cooperating with the other rocker.

The rocker arm can comprise alternative coupling means between the pad and one or the other of the rockers.

The coupling means can comprise a jack with a piston provided with two rods cooperating through locking with said rockers.

The piston rod can secure the rocker to the pad through cooperation with a hole provided in said rocker.

The jack can be particularly advantageously carried by the pad.

The pad can preferably comprise an outlet for discharging the fluid out of the jack.

In cases where the rocker arm swivels round a rocker arm shaft, the rocker arm shaft can be a rotary shaft comprising a delivery channel for carrying the fluid to said jack and a linking channel connected to a fluid discharge passage carried by the pad.

The engine can comprise means intended for motion transmission between the camshaft and the engine crankshaft with a transmission ratio allowing said shaft to be rotated at one third of the rotating speed of said crankshaft and means intended for motion transmission between the camshaft and the rocker arm shaft with a transmission ratio allowing said rocker arm shaft to be rotated at half the rotating speed of the camshaft.

The present invention also relates to the use of such an engine for operation at low or medium engine loads, with a cycle comprising at least two additional phases to the conventional phases of intake, compression, combustion of a fuel mixture and exhaust of the burnt gases.

These additional phases can be, after the conventional exhaust phase, a burnt gas expansion phase followed by an expanded burnt gas recompression phase.

BRIEF DESCRIPTION OF THE FIGURES

Other features and advantages of the invention will be clear from reading the description hereafter, given by way of non limitative example, with reference to the accompanying figures wherein.

DETAILED DESCRIPTION

Figure 1:
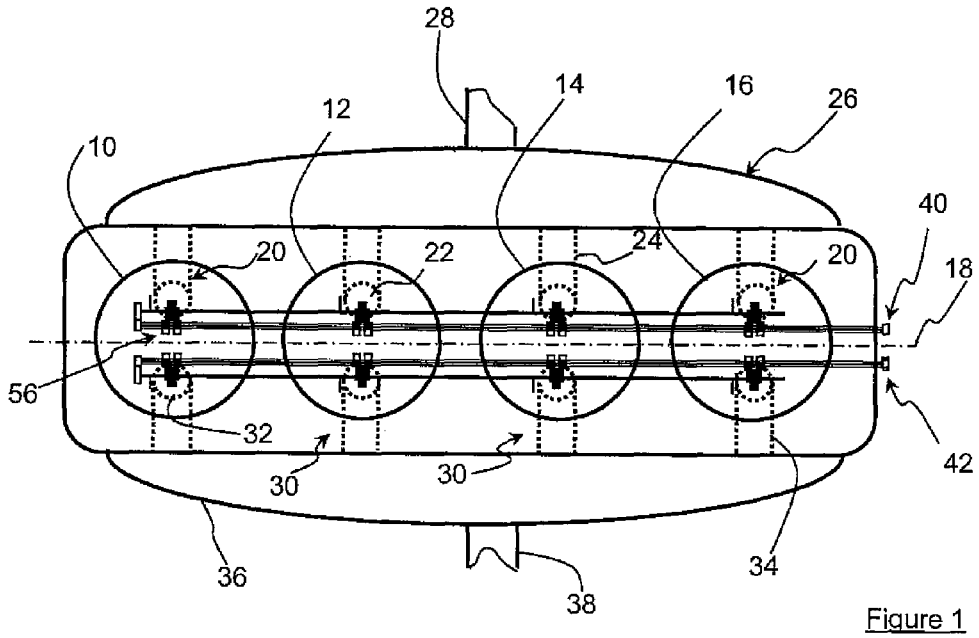
- FIG. 1 shows an internal-combustion engine according to the invention.

In FIG. 1, the internal-combustion engine of direct fuel injection type, notably a gasoline type engine, comprises at least one cylinder, here four cylinders 10, 12, 14, 16, and at least one of the cylinders can have a degraded operation mode for low or medium loads.

Each cylinder contains a piston (not shown) sliding in a reciprocating rectilinear motion while being connected to a crankshaft (shown by axis line 18). The piston thus delimits with the cylinder a combustion chamber where combustion of a fuel mixture can take place when the requirements for such a combustion are met.

This piston varies between an upper position referred to as top dead center (TDC), where the combustion chamber occupies a reduced volume, and a lower position referred to as bottom dead center (BDC), where the volume of the combustion chamber is the larger. The stroke of this piston between these two dead centers corresponds to an operation phase.

As illustrated in this figure, each cylinder comprises intake means 20 with at least one intake valve 22 controlling an intake pipe 24. The intake pipes are connected to an intake manifold 26 that is connected to an inlet 28 for a fluid such as outside air.

The outside air can be either air at ambient pressure or supercharged air that is compressed by a turbocompressor for example prior to being fed into the cylinders. This air, whether at ambient pressure or supercharged, can also be mixed with exhaust gas if the engine works in EGR (Exhaust Gas Recirculation) mode.

Each cylinder also comprises exhaust means 30 with at least one exhaust valve 32 controlling an exhaust pipe 34 connected to an exhaust manifold 36 connected to an exhaust line 38 allowing the burnt gases resulting from the combustion of the fuel mixture in the cylinders to be discharged to the atmosphere.

Of course, this line can comprise means such as catalysts for depolluting these exhaust gases prior to discharging them to the atmosphere.

As it is known per se, each cylinder comprises fuel injection means (not shown) for achieving a fuel mixture in the cylinder. Ignition of this fuel mixture can be obtained either by ignition means such as a spark plug (not shown) or by auto-ignition.

Opening and closing of these intake valves 22 and exhaust valves 32 is controlled by control means 40, respectively 42, whose description is given hereafter in detail.

Figure 2:
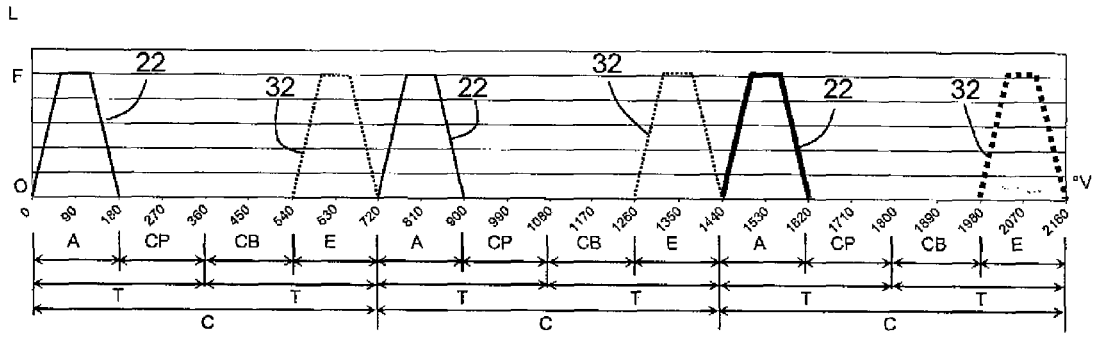
- FIGS. 2 and 3 are graphs showing the various valve lift laws (L) as a function of the crank angle (°V) for the engine according to the invention.
Figure 3:
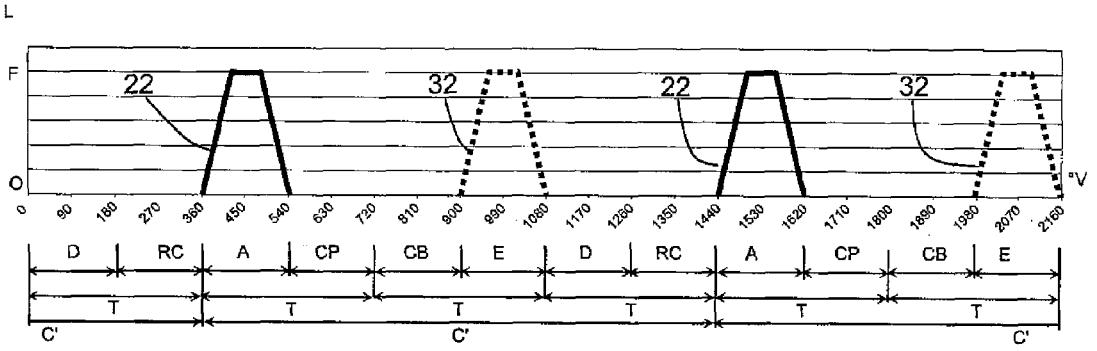

These control means are configured in such a way that, in combination with the fuel injection means and possibly the ignition means in the case of a spark-ignition engine, cylinders 10 to 16 can meet the two operation configurations illustrated in FIGS. 2 and 3.

In the case of a conventional operation as illustrated in FIG. 2, notably for high load levels, cylinders 10 to 16 work according to a conventional cycle (C) of four phases during two crankshaft rotations (T). This cycle comprises, during one rotation, an intake phase (A) between the TDC and the BDC of the piston with an opening and closing sequence of intake valve 22, a compression phase (CP) between the BDC and the TDC of this piston, then, during the next rotation, a combustion phase (CB) of the fuel mixture present in the cylinder going from the TDC of the piston to the BDC thereof and an exhaust phase (E) of the burnt gases going from the BDC to the TDC with an opening/closing sequence of exhaust valve 32. These four conventional phases are repeated during two crankshaft rotations, i.e. 720° crank angle. Each cycle (C) thus starts with an intake phase (A) and ends with an exhaust phase (E).

In the case of the configuration of FIG. 3 illustrating operation at low or medium loads, at least one cylinder, here cylinder 10, works in degraded mode with a cycle (C') of six phases during three crankshaft rotations (T). These phases include the aforementioned four phases (intake phase, compression phase, combustion phase and exhaust phase in two rotations) followed, during an additional rotation, by two additional phases: an expansion phase (D) during which the residual burnt gases contained in the cylinder are expanded between the TDC and the BDC of the piston and a phase of recompression (RC) of the expanded burnt gases with a piston stroke between the BDC towards the TDC. The latter two phases are performed by maintaining the intake and exhaust valves closed. This operating cycle (C') thus starts with an intake phase (A) and ends with a recompression phase (RC).

Thus, in conventional operation, the engine works with all the cylinders following the four-phase cycle with, more precisely, a combustion phase every four phases, i.e. every two rotations.

In the case of operation at low or medium loads, the engine is operated with all or part of the cylinders working in degraded mode with a single combustion phase (CB) according to a six-phase cycle with three crankshaft rotations. In cases where only part of the cylinders works in degraded mode, the remaining part of the cylinders works in conventional mode.

This allows, unlike engines of the prior art with cylinder deactivation, to maintain the temperature of the various cylinder elements (cylinder wall, piston, . . . ) and not to disturb the exhaust line while significantly reducing the fuel consumption.

Figure 4:
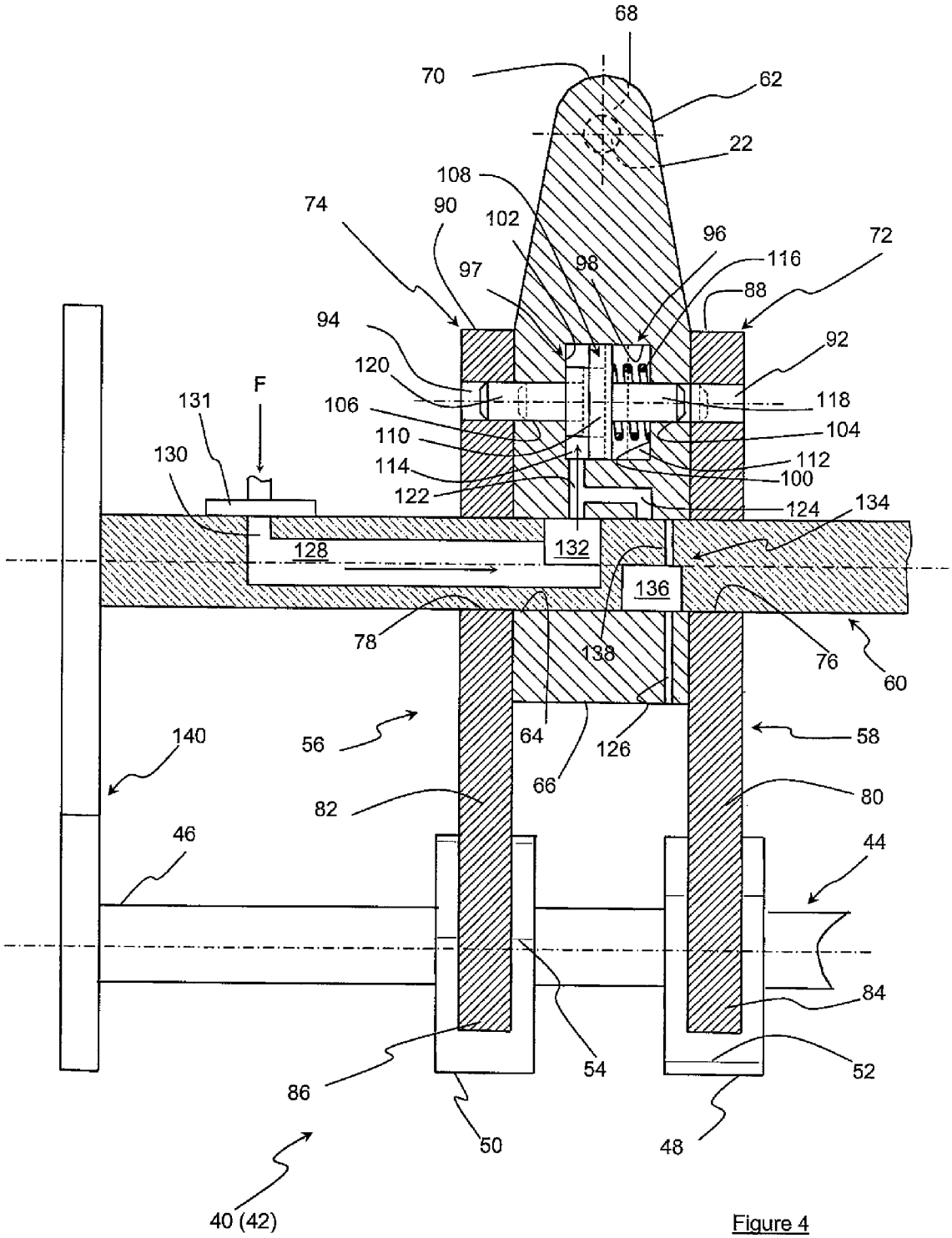
- FIG. 4 illustrates a valve control mechanism for the engine according to the invention.

As illustrated in FIG. 4, intake valve control means 40 and exhaust valve control means 42 therefore comprise drive means and means intended for motion and load transmission between these drive means and the valve to be controlled. These control means allow the cylinder considered to be operated either in degraded mode or in conventional mode.

The description hereafter will only mention control means 40 applied to intake valve 22, but this description also applies to control means 42 relative to exhaust valve 32.

In the example of FIG. 4, the drive means include a rotary camshaft 44. This camshaft comprises a shaft 46 fixedly carrying a first cam 48 and a second cam 50, at a distance from one another, with different cam profiles 52, 54, and controlling this valve.

The terms "first" and "second" used in the description do not refer to the order of use, they are used only to differentiate from one another two substantially identical elements.

Motion and load transmission means 56 between drive means 44 and intake valve 22, symbolized by the circle in dotted line, comprise a rocker arm 58 swivelling around a rocker arm shaft 60 that itself rotates round its longitudinal axis. This rocker arm shaft is arranged between intake valve 22 and camshaft 44, and it is substantially parallel to this camshaft.

The rocker arm comprises a flat pad 62 of elongate profile comprising, in the vicinity of its end 66 that is the closest to the camshaft, a bore 64 cooperating through rotational sliding with the rocker arm shaft and a contact zone 68 with the stem of valve 22 in the vicinity of its other end 70.

A first rocker 72 and a second rocker 74 are arranged axially on either side of this pad and in contact therewith, in form of a bar, and they are also mounted pivoting on rocker arm shaft 60 by means of a bore 76, 78 carried by body 80, 82 of these rockers.

The longitudinal dimensions of these rockers are such that one 84 of the ends of first rocker 72 rests on first cam 48 and one 86 of the ends of second rocker 74 rests on second cam 50.

The other ends 88, 90 of the rockers comprise cooperation means, here a first hole 92 and a second hole 94 substantially parallel to the rocker arm shaft, with coupling means 96 carried by pad 62. These means are provided for alternatively coupling (or uncoupling) either first rocker 72 with pad 62 or second rocker 74 with this pad.

The coupling means comprise a jack 97 of single-effect hydraulic jack type carried by pad 62.

This jack comprises a cavity 98, cylindrical for example, with two vertical flanks 100, 102, provided in the body of the pad. This cavity is extended, in the direction of the rockers and from the flanks, by bores 104, 106, preferably cylindrical and coaxial to the cavity, respectively provided opposite holes 92, 94 and of same radial dimension. A translative piston 108, preferably stepped, is located in this cavity with a piston body 110 allowing to delimit two sealed chambers 112, 114, one 112 comprising an elastic means such as a return spring 116. This piston body carries, on either side, a first rod 118 and a second rod 120 that cooperate with bores 104, 106, then with one or the other of holes 92, 94 of rockers 72, 74.

A passage 122 allowing circulation of a control fluid under pressure such as oil is provided between cavity 98 and bore 64 of the pad, this passage opening as close as possible onto vertical wall 102 of chamber 114 that comprises no spring. This passage also comprises a fluid circulation bypass 124 communicating this passage with bore 64. A fluid discharge passage 126 is also provided in the pad at a distance from the delivery passage. This discharge passage is advantageously arranged between bore 64 and the edge of end 66 of the pad.

Rocker arm shaft 60 internally comprises an axial channel 128 for delivering fluid under pressure, with a radial fluid inlet 130 communicating, from the periphery of this shaft, with an inlet box 131 intended for fluid under pressure F. This channel also comprises a fluid outlet 132 radially opening onto the periphery of this shaft while coinciding with communication passage 122.

Inlet 130 and outlet 132 of channel 128, as well as box 131, are dimensioned in such a way that they allow chamber 114 to be supplied throughout the half-turn rotation of rocker arm shaft 60 as shown in FIG. 4.

This shaft also comprises a substantially radial linking channel 134 arranged at a distance from the delivery channel. This linking channel comprises a radial bowl 136 continued by a linking passage 138 whose cross-section is substantially equal to the cross-section of discharge passage 126.

The configuration of this channel is such that the bowl can communicate with bypass 124 and the linking passage can communicate with discharge passage 126 for another half-turn rotation of the rocker arm shaft, as explained in the description below.

Of course, sealing means are provided between the various moving and fixed parts to prevent any control fluid leaking.

The rocker arm shaft and the camshaft are kinematically connected in rotation by any transmission means such as a gear train 140 so that the rotating speed of the rocker arm shaft is half the speed of the camshaft.

The rotating motion of this camshaft is conventionally controlled by crankshaft 18 through a timing belt (or a chain, or a pinion train) so that the rotating speed of this camshaft is one third of the speed of the crankshaft.

Thus, in concrete terms, for a three-turn rotation of the crankshaft, the camshaft rotates once whereas the rocker arm shaft rotates by a half-turn.

Under conventional operation conditions of the engine cylinders, notably at full loads, the control means are initially in the configuration of FIG. 4.

Fluid under pressure F is fed through box 131 to inlet 130. This fluid circulates in channel 128 and ends at outlet 132, then it is carried through communication passage 122 into chamber 144. This fluid under pressure fills chamber 144 while driving the piston to the right (considering this figure) and compressing spring 116.

When this position is reached (illustrated in dotted line in the figure), first rod 118 of this piston cooperates with hole 92 of first rocker 72 and second rod 120 has cleared hole 94 of second rocker 74.

Therefore, during rotation of the camshaft by a complete turn corresponding to the half-turn rotation of the rocker arm shaft, second cam 50, which is in contact with end 86 of second rocker 74, causes this rocker to swivel around rocker arm shaft 60. Since this rocker is no longer mechanically linked to pad 62 as it has been uncoupled from this pad, it cannot act upon the valve stem through pad 62.

On the other hand, the rotation of first cam 48 leads to control of intake valve 22. In fact, by actuating coupling between pad 62 and rocker 72, the rotation of this cam allows to generate tilting of the assembly made up of pad 62 and first rocker 72 around the rocker arm shaft through contact of end 84 of this rocker with profile 52 of first cam 48. By means of this tilting, contact zone 68 of the pad generates translational displacement of the valve by opening/closing the orifice of the pipe controlled thereby.

In connection with FIG. 2, the rotation of the camshaft by one turn occurs during a three-turn rotation of the crankshaft, therefore from 0 to 1080 crank degrees.

During the one-turn rotation of this camshaft, the rocker arm shaft rotates by a half-turn with a position of jack rods 118, 120 as illustrated in dotted line in FIG. 4.

Thus, during operating cycle (C), the intake valve follows an opening/closing sequence between 0 and 180 crank degrees, then, during the next cycle (C), an opening/closing sequence between 720 and 900 crank degrees.

Cam 48 therefore comprises a suitable profile allowing to carry out, during one camshaft turn, this succession of sequences.

Figure 5:
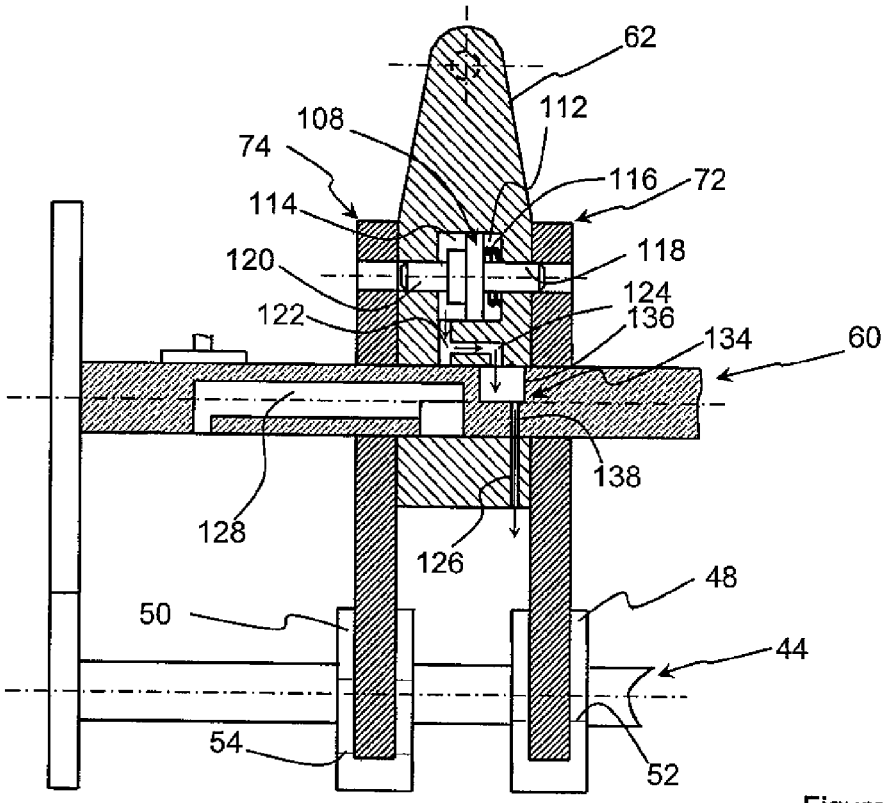
FIG. 5 shows the mechanism of FIG. 4 in another position according to the invention.

When rocker arm shaft 60 has ended its half-turn under the action of the camshaft, it is in the position illustrated in FIG. 5.

In this position, not only is the fluid no longer fed into delivery channel 128, but this channel is also no longer in connection with fluid communication passage 122.

Chamber 114 is therefore no longer under pressure and bypass 124 communicates, through linking channel 134, with discharge passage 126.

Under the effect of return spring 116 present in chamber 112, piston 108 is driven towards the left (considering this figure) and the fluid contained in chamber 114 is expelled therefrom.

This fluid then travels part of communication passage 122 and bypass 124, and it ends in bowl 136 of linking channel 134. From this bowl, the fluid flows through linking passage 138 and discharge passage 126 in order to reach any fluid receiving means such as a tank or a drum.

Finally, piston 108 and its rods 118, 120 are in the configuration where first rocker 72 is uncoupled from pad 62 whereas rocker 74 is coupled to this pad.

During the rotation of the crankshaft by three additional turns, thus from 1080 to 2160 crank degrees, the camshaft rotates by one turn and the rocker arm shaft rotates by a half-turn.

Under the action of second cam 50 that comprises a suitable profile 54, the intake valve follows an opening/closing sequence between 1440 and 1620 crank degrees to start the next operating cycle (C).

When rocker arm shaft 60 has ended its half-turn under the action of the camshaft, it is in the position illustrated in FIG. 4. Furthermore, piston 118 is, under the action of spring 116, in the initial position illustrated in this figure.

During degraded operation of at least one cylinder 10, as in the case of low or medium engine loads, this cylinder is to be operated with a cycle (C') allowing to have a combustion phase (CB) every six phases, as described in connection with FIG. 3.

By way of non limitative example, during degraded operation of cylinder 10, the other cylinders 12 to 16 work in conventional mode.

Therefore, from the configuration of FIG. 4, fluid delivery channel 128 is not supplied with fluid under pressure throughout the one-turn rotation of rocker arm shaft 60. First rocker 72 therefore remains uncoupled from pad 62 throughout this rotation and second rocker 74 remains constantly coupled to this pad.

Considering profile 54 of second cam 50, intake valve 22 follows an opening/closing sequence according to an operating cycle (C') every three turns, such as between 360 and 540 crank degrees, then according to the next cycle (C') between 1440 and 1620 crank degrees.

Thus, this configuration allows, as already mentioned, to obtain a single combustion phase (CB) with a six-phase operating cycle (C').

Since exhaust valve 32 is subjected to control means identical to those of the intake valve, this exhaust valve also follows opening/closing sequences with a 540° angular offset, whether under conventional engine cylinder operating conditions or in degraded operation mode at low or medium loads.

Of course, the fluid inflow into channel 128 is controlled by a hydraulic circuit (not shown) controlled by a control unit (not shown) any engine is usually equipped with. This unit contains maps or data charts allowing to operate all or part of the cylinders depending on the engine evolution conditions.

Similarly, this unit allows to control the parameters for fuel injection into the cylinder, as well as the ignition parameters for the fuel mixture present in this cylinder.

Figure 6:
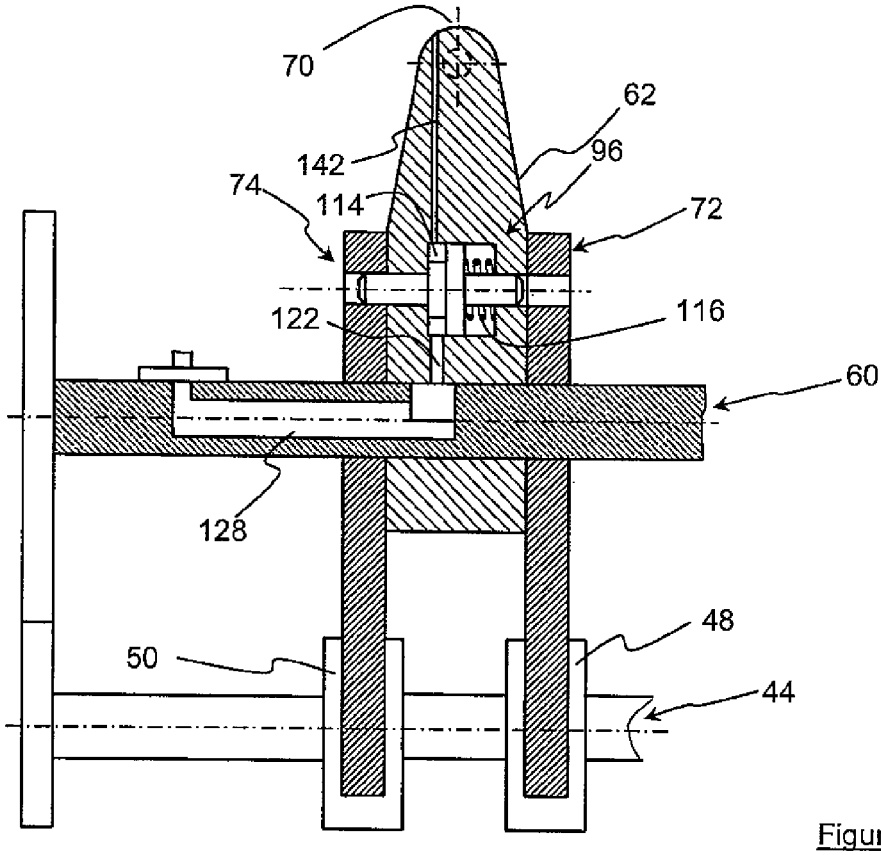
FIG. 6 is a variant of the valve control mechanism of FIG. 4.

The variant of FIG. 6 differs from the example of FIG. 4 in the layout intended for discharge of the fluid expelled from chamber 114 from coupling means 96.

In this variant, bypass 124, linking channel 134 (linking bowl 136, linking passage 138) and discharge passage 126 are replaced by a calibrated discharge channel 142 contained in pad 62. This channel, of calibrated cross-section, starts at chamber 114 and ends at an edge of end 70 of the pad.

When the cylinder works in conventional mode, the fluid is fed under pressure into chamber 114 through delivery channel 128 and communication passage 122, as already explained in connection with FIG. 4. This fluid exerts a pressure on the piston by driving it to the right of the figure. Considering the calibration of discharge channel 142 that the person skilled in the art will have first determined by any means, the fluid fed into chamber 114 is caused to leave again through this channel but with a lower flow rate than the flow rate from communication passage 122. Because of the pressure differential between the delivery of the fluid and its discharge, the pressure prevailing in the chamber is sufficient to maintain the piston in its position illustrated in FIG. 5.

When fluid delivery is stopped, no pressure prevails in chamber 114. Under the action of spring 116, the fluid contained in this chamber is discharged through channel 142 and the piston reaches the position illustrated in FIG. 6.

The present invention is not limited to the embodiment described and it encompasses all variants or equivalents.

The invention claimed is:

1. An internal-combustion engine, comprising at least one cylinder including intake means with an intake valve, exhaust means with an exhaust valve, a system for controlling opening/closing of the valves, the system for controlling opening/closing of the valves comprising a camshaft carrying a plurality of cams, drive means for driving the camshaft and a rocker arm with at least two rockers, each of which is disengageable from a pad controlling the motion of one of the intake valve or the exhaust valve, each of the cams cooperating with each of the at least two rockers, wherein one of the cams comprises a cam profile -cooperating with one of the rockers that is different from the cam profile -of the other cam cooperating with the other rocker.

2. The internal-combustion engine as claimed in claim 1, characterized in that the rocker arm comprises alternative coupling means between the pad and one or the other of the rockers.

3. The internal-combustion engine as claimed in claim 2, characterized in that the coupling means comprise a jack with a piston provided with two rods cooperating through locking with said rockers.

4. The internal-combustion engine as claimed in claim 3, characterized in that the piston rod secures rocker to the pad through cooperation with a hole provided in said rocker.

5. The internal-combustion engine as claimed in claim 4, characterized in that the jack is carried by the pad.

6. The internal-combustion engine as claimed in claim 3, characterized in that the pad comprises an outlet for discharging fluid out of the jack.

7. The internal-combustion engine as claimed in claim 3, wherein the rocker arm swivels round a rocker arm shaft, characterized in that the rocker arm shaft is a rotary shaft comprising a delivery channel for carrying fluid to said jack and a linking channel connected to a fluid discharge passage carried by the pad.

8. The internal-combustion engine as claimed in claim 7, characterized in that it comprises means intended for motion transmission between camshaft and the engine crankshaft with a transmission ratio allowing said rocker arm shaft to be rotated at one third of the rotating speed of said crankshaft and means intended for motion transmission between camshaft and rocker arm shaft with a transmission ratio allowing said rocker arm shaft to be rotated at half the rotating speed of the camshaft.

9. Use of an internal-combustion engine as claimed in claim 1 for operation at low or medium engine loads, with a cycle comprising at least two additional phases to the conventional phases of intake, compression, combustion of a fuel mixture and exhaust of the burnt gases.

10. Use of an engine as claimed in claim 9 with, after the conventional exhaust phase, a burnt gas expansion phase followed by an expanded burnt gas recompression phase.

11. The internal-combustion engine as claimed in claim 1, further comprising a control unit for controlling engagement of one of the rockers and disengagement of the other rocker.

12. The internal-combustion engine as claimed in claim 11, wherein the internal-combustion engine comprises a plurality of cylinders and the control unit contains maps or data charts and is configured to actively operate all of the cylinders or to make at least one cylinder inactive for operation at low or medium engine loads, and wherein the control unit controls engagement of one of the rockers and disengagement of the other rocker during conventional operation and engagement of the other rocker and disengagement of the one rocker during operation at low or medium engine loads.

13. The internal-combustion engine as claimed in claim 12, wherein the control unit controls the internal-combustion engine for operation at low or medium engine loads with a cycle comprising at least two additional phases to the conventional phases of intake, compression, combustion of a fuel mixture and exhaust of the burnt gases.

14. The internal-combustion engine as claimed in claim 12, wherein the control unit controls the internal-combustion engine for operation at low or medium engine loads with a cycle comprising a burnt gas expansion phase followed by an expanded burnt gas recompression phase after the conventional phases of intake, compression, combustion of a fuel mixture and exhaust of the burnt gases.

* * * * *